United States Patent [19]

Ranzanigo

[11] 4,032,878

[45] June 28, 1977

[54] CARTRIDGE FUSE CARRIER ASSEMBLY

[75] Inventor: Pierluigi Ranzanigo, Brescia, Italy

[73] Assignee: Bassani S.p.A., Milan, Italy

[22] Filed: Jan. 22, 1976

[21] Appl. No.: 651,394

Related U.S. Application Data

[63] Continuation-in-part of Ser. No. 456,278, March 29, 1974, Pat. No. 3,936,787.

[30] Foreign Application Priority Data

Feb. 6, 1975 Italy ..... 19996/75
May 30, 1973 Italy ..... 24840/73

[52] U.S. Cl. ..... 337/228; 337/213; 337/215; 337/236

[51] Int. Cl.[2] ..... H01H 85/14

[58] Field of Search ..... 337/231, 227, 228, 229, 337/234, 236, 237, 239, 213–215

[56] References Cited

UNITED STATES PATENTS 3,299,236 1/1967 Barker ..... 337/214 X
3,936,787 2/1976 Ranzanigo ..... 337/236 X

FOREIGN PATENTS OR APPLICATIONS 701,047 12/1953 United Kingdom ..... 337/214

*Primary Examiner*—Robert J. Hickey
*Attorney, Agent, or Firm*—Michael J. Striker

[57] ABSTRACT

A cartridge fuse carrier assembly has a housing with a recess for receiving a cartridge fuse. The fuse is held between a contact member co-operable with one end of the fuse at the bottom of the recess and a cap at the opening of the recess, the cap carrying a contact member co-operable with the other end of the fuse. The cap also carries locking means which are moved into the cap-securing position by a transverse movement of the cap relative to the recess, after the cap has been fitted into the opening of the recess. One or more wall surfaces of the recess, and adjacent surface or surfaces of the cap, define a rib and groove coupling arrangement, with the or each rib and co-operating groove being relatively displaced with respect to each other by a distance substantially equal to the length of the transverse movement.

8 Claims, 2 Drawing Figures

CARTRIDGE FUSE CARRIER ASSEMBLY

CROSS-REFERENCE TO RELATED APPLICATION

This application is a continuation-in-part application Ser. No. 456,278, filed Mar. 29, 1974, now U.S. Pat. No. 3,936,787, which application is entitled CARTRIDGE FUSE CARRIER ASSEMBLY.

BACKGROUND OF THE INVENTION

Cartridge fuses are often included in circuits for the protection of electrical equipment, for example in each phase, including the neutral conductor, of an electrical circuit. Such a fuse may be carried in a fuse holder which is an independent unit connected into the circuit to be protected, or in a fuse holder which is combined with for example an electrical switch. In the latter case the fuse may be inserted into a suitable recess or housing provided in the insulating casing of the switch, which may be manual or automatic.

It has been proposed that a cartridge fuse can be secured in the housing by a ring nut which is screw-threadedly fitted onto a screw-threaded ring at the mouth of the housing, the ring nut being tightened on the ring to provide a locking action to secure the fuse in the housing. Tightening of the ring nut also causes a compression force to be applied to the cartridge fuse in the axial direction thereof, to ensure electrical contact and continuity. However, the ring nut is not always capable of maintaining a secure contact with the correct degree of compression of the cartridge fuse, since the ring nut may tend to become slackened. In addition, the production and fitting of a ring nut and a companion screw-threaded ring generally involve substantial cost.

SUMMARY OF THE INVENTION

It is an object of the invention to provide a cartridge fuse carrier assembly which provides for rapid insertion and replacement of a cartridge fuse.

A further object of the invention is to provide such an assembly which has simplified means for locating and receiving a cartridge fuse, and to ensure adequate electrical contact of the cartridge fuse with the electrical terminals of the assembly.

Yet another object of the invention is to provide a cartridge fuse carrier assembly so constructed that the electrical terminals cannot be readily touched inadvertently by a human operator.

A still further object of the invention is to provide such an assembly in which the fuse does not readily come out of electrical engagement with the electrical terminals, even when subjected to repeated impact and/or vibration.

These and other objects are achieved by means of a cartridge fuse carrier assembly which comprises a housing which can be connected into an electrical circuit. The housing provides a recess for receiving a cartridge fuse, and a first contact member is disposed in the recess, being connected to a first of the electrical connection terminals. The recess can be closed by an insulating cap, which thereby secures the cartridge fuse in the recess, while the cap carries an electrically conducting member to form a connection between a conducting end member of the fuse and a second electrical terminal. The cap has engagement means which secure the cap at the opening of the recess by a first displacement of the cap in the axial direction of the recess, which causes the fuse to be brought into abutment against the first contact member in the recess, and then a second displacement effected in a rectilinear direction which is transverse with respect to the axis of the recess. An outside surface of the cap, and a corresponding inside surface of the recess, carry a rib and groove arrangement, with the ribs and grooves being elongate in the axial direction of the recess. The ribs and grooves are so arranged that, before the above-mentioned rectilinear movement transversely of the axis of the recess, each co-operating rib and groove are transversely displaced relative to each other by a distance which is equal to the extent of the rectilinear movement, so that, after the first displacement of the cap has been performed, the respective ribs and grooves then come into engagement with each other, preferably with a snap action, at or towards the end of the transverse mevement.

DESCRIPTION OF THE PREFERRED EMBODIMENT

Figure 1:
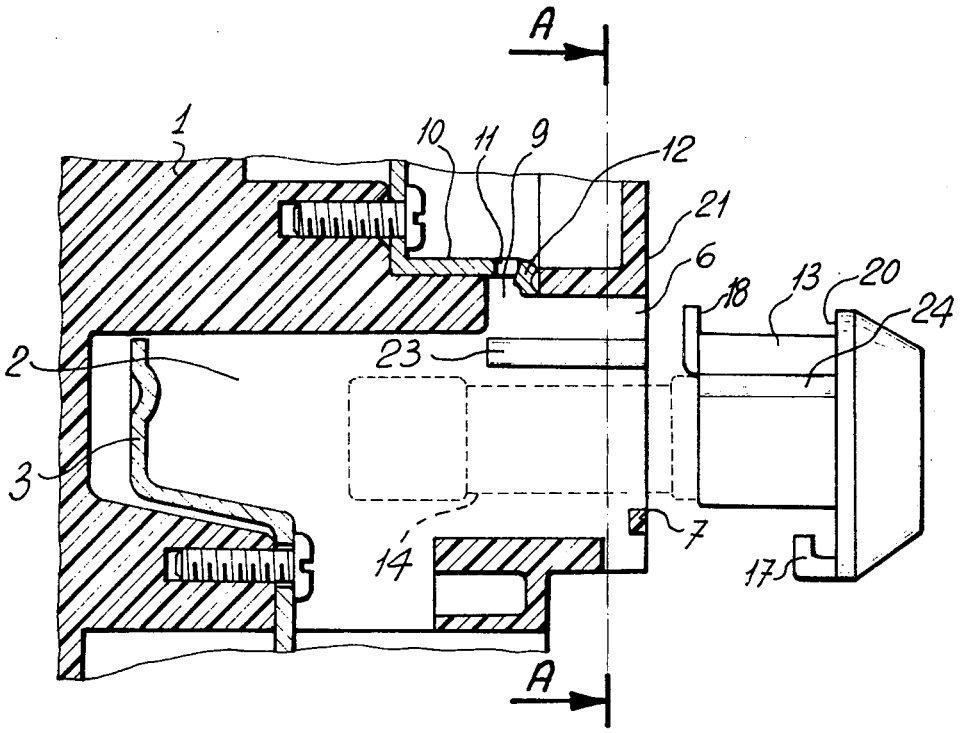
FIG. 1 is a view in partial cross-section of the carrier assembly, showing the cap removed but ready to be fitted and showing in dotted lines a cartridge fuse in a partially disengaged position.

Referring to FIG. 1, a cartridge fuse carrier assembly comprises a housing 1 of insulating material. The housing 1 may be the housing of an independent fuse holder, or it may be a part of the casing of a device such as a manual or automatic switch, that is to say in this case, a switch and the fuse carrier assembly are combined into a single unit.

The housing 1 shown has a recess 2, although the housing 1 may have a plurality of such recesses where a plurality of cartridge fuses are to be carried by the carrier assembly, for example when it is necessary to include a fuse in each phase conductor line of an electrical circuit to be protected, including the neutral line. As can be seen from the drawing, the recess 2 is closed at one end, being the lefthand end in the drawing.

An electrical contact member 3 is arranged partly within the recess 2. The contact member 3 is resiliently flexible and is of an angularly bent configuration, including a contact portion adjacent the bottom or closed end of the recess 2, and a portion adjacent the bottom or closed end of the recess 2, and a portion forming part of a first connecting terminal (not shown in its entirety).

The recess 2 is open outwardly of the housing 1, at the right-hand end, by means of an opening 6. A transverse member 7 is disposed across the opening 6, adjacent to and slightly above the bottom edge of the opening 6.

Just inside the opening 6 of the recess 2, and in the side of the recess 2 which is opposite the side thereof terminating at the edge 8, is an opening 9. A contact member 10 providing a second connecting terminal of the assembly extends across the opening 9 as shown, and has a slot 11 which is in line with the opening 9. One edge portion 12 of the contact member 10 is bent towards the opening 9. The purpose of this arrangement will be apparent hereinafter.

The carrier assembly comprises a cap 13 made for example of insulating material, for closing the opening 6 of the recess 2. When the cap 13 is fitted into position at the opening 6 of the recess 2, as in FIG. 2, a cartridge fuse 14 will be locked in position in the recess 2, and will be subjected to a compression force in its axial direction.

Figure 2:
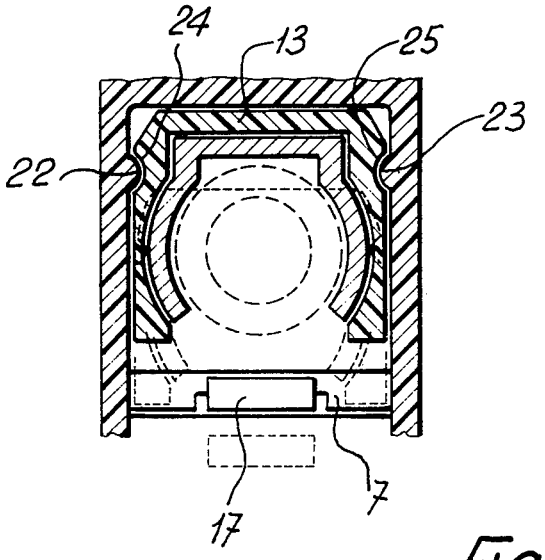
FIG. 2 is a view in section along line A—A in FIG. 1 of the carrier assembly, showing the cap and fuse secured in position in the recess of the assembly.

The cap 13 also has on one side, being the downwardly facing side in FIGS. 1 and 2, a securing member 17 which is secured to or in one piece with the cap 13. The member 17 is generally hook-shaped as shown. The arrangement of the member 17 is such that when the cap 13 is fitted into the opening 6 of the recess 2, the transverse member 7 fits into the cavity defined by the hook shape of the member 17, to hold the cap 13 in a locked position.

At its side remote from the member 17, the cap 13 carries a radially projecting lug or tab 18 of electrically conducting material, arranged to engage into the slot 11 in the contact member 10 to secure the cap 13. The fuse 14 will be suitably held in the cap 13, with an end cap member of the fuse in electrical contact with the lug or tab 18.

Referring now also to FIG. 2, it will be seen that the facing internal surfaces defining the side walls of the recess 2 each have an inwardly projecting elongate rib 22 and 23 respectively. Each of the ribs 22 and 23 (of which only the rib 23 is shown in FIG. 1) extends from the opening 6 of the recess axially towards the closed end of the recess 2. Furthermore, the surfaces of the cap 13 which, in the engaged position of the cap (as in FIG. 2),lie adjacent or in contact with the above-mentioned internal surfaces of the recess 2 are each provided with a groove 24 and 25 respectively, each of which grooves is co-operable with a respective rib 22 and 23. This co-operation is clearly shown in FIG. 2.

It will be noted that in the position of FIG. 1 in which the cap is aligned with the opening 6 for insertion into the recess 2, the ribs 22 and 23 are not longitudinally aligned with the grooves 24 and 25. The relative displacement or off-setting of the ribs and grooves, as viewed in a vertical direction in the FIG. 1 position, is at least substantially equal to the extent of the above-mentioned transverse movement of the cap 13 for securing the cap 13 in the recess 2. Further reference to this displacement will be made below. It will be apparent that, while the ribs and grooves may be substantially longer or substantially shorter than those shown, the ribs and grooves are preferably each substantially equal in length to each other, although the ribs may be somewhat shorter than the grooves, without having a detrimental effect. It will also be apparent that the rib and groove arrangement shown could be reversed, that is, the ribs could be provided on the cap, and the grooves in the side walls of the recess, and the assembly may have just one rib and one groove, or more than two of each.

The cartridge fuse 14 is fitted into the above-described carrier assembly, in the following manner:

One end cap member of the cartridge 14 is first fitted into the cap 13, and then the end of the cartridge fuse 14 remote from said one end cap member is then inserted into the recess 2. The cap 13 with cartridge fuse 14 are moved in the axial direction of the recess 2 until a shoulder 20 of the cap 13 bears against a surface 21 around the opening 6. In this position, the lug or tab 18 will be in alignment with the slot 11, the transverse member 7 will be in alignment with the cavity in the member 17, and the left-hand end cap of the cartridge fuse will bear firmly against the contact member 3 in the recess 2. When the cartridge fuse 14 has been displaced axially, it presses against the member 3 which is thus resiliently deflected, the resilient deflection producing a compression force in the axial direction on the cartridge fuse.

When the cap has been introduced into the recess 2 by the above-described axial movement, it will be apparent that the ribs 22 and 23 are not aligned with or engaged in the respective grooves 24 and 25, because of the relative displacement thereof as mentioned above.

The cap 13 is then moved transversely of the recess 2, for example in an upward direction as viewed in FIG. 1, so that the lug or tab 18 engages into the slot 11 and the transverse member 7 engages into the cavity of the member 17. The cartridge fuse is now held firmly between the cap 13, and the contact member 3. As the cap 13 is moved transversely of the recess 2, the grooves 24 and 25 will be brought into alignment with the respective ribs 22 and 23 so that the ribs engage into the grooves with a snap action. This snap action is made possible by virtue of resilient deformation of the wall members carrying the grooves 24 and 25, and/or the wall members carrying the ribs 22 and 23, such wall members preferably being made of a plastics material, generally of relatively small thickness. It will be noted that the edges of the cap 13, which are the upper edges as viewed in FIG. 2, are bevelled or chamfered, or may alternatively be rounded, in order to facilitate the transverse movement of the cap 13, the enable the cap 13 more easily to move past the ribs 22 and 23 into the engaged position of FIG. 2.

It will be appreciated that the above-mentioned relative displacement (in FIG. 1) of the ribs and grooves with respect to each other is equal to the extent of the transverse movement by which the cap 13 is brought into the secured position in the recess 2, as described above.

It will be seen therefore that in the secured position the cap is held in place not only by virtue of the lug or tab 18 engaging into the opening 9 and slot 11, and the co-operation of the member 17 and the member 7, but also by virtue of the co-operation of the ribs 22 and 23 and grooves 24 and 25, which will assist in preventing the tendency of the cap 13 to move transversely back towards a position in which the lug or tab 18 and the member 17, could come out of engagement with the slot 11 and the member 7 respectively. The ribs and grooves will also assist in preventing any rotary movement of the cap 13 which could occur and which could possibly result in the cap 13 becoming disengaged.

The cartridge fuse and cap can be removed by reversing the sequence of the above-described operations.

It will be noted that the contact member 10 is not readily accessible to an operator's fingers or a tool, and does not therefore represent an injury hazard, even when electrically live. It should also be noted that while the fuse 14 is subjected to an axial compression force by viture of the resiliency of the contact member 3, it would also be possible to provide other, possibly independent resilient means, such as a spring, to produce such force.

Various modifications can be made in the above-described embodiment without thereby departing from the spirit and scope of the invention as defined by the appendant claims, and in particular the position and the configurations of the ribs and grooves, as well as the number thereof, could be varied.

What is claimed is:

1. A cartridge fuse carrier assembly comprising: a housing; first and second connection terminals for connecting the assembly into an electrical circuit; a recess in the housing for receiving a cartridge fuse; a first contact member in the recess and having an electrical connection with the first terminal; an insulating cap for closing the recess, to secure the cartridge fuse therein; a second contact member in the housing and having an electrical connection with the second terminal; an electrically conducting member carried by the cap for co-operating with a first end member of the cartridge fuse, to provide an electrical connection between the first end member of the cartridge fuse and the second contact member; and engagement means on the cap co-operable with the housing for securing the cap at the opening of the recess, by displacement of the cap carrying the cartridge fuse in the axial direction of the recess whereby a second end member of the fuse is brought into abutment against said first contact member, and then displacement of the cap in a second rectilinear direction transverse with respect to the axial direction of the recess to bring the engagement means into the cap-securing position, an internal surface of the recess and a surface of the cap which in the cap-secured position lies adjacent said surface of the recess providing a co-operable rib and groove arrangement, with the rib and the groove being displaced relative to each other transversely of the axial direction of the recess, when the cap is at the end of said axial displacement, by a distance at least substantially equal to the extent of said second rectilinear movement of the cap whereby when the cap is axially introduced into the recess the rib and the groove are not engaged with each other but when said second rectilinear movement is effected the rib and the groove engage into each other with a snap action.

2. An assembly according to claim 1 wherein the rib is on the surface of the recess and the groove is in the surface of the cap.

3. An assembly according to claim 1 wherein there are two said ribs on oppositely directed internal surfaces of the recess, and two said grooves on oppositely directed external surfaces of the cap, the rib and the groove of each co-operating pair being displaced relative to each other as aforesaid.

4. An assembly according to claim 1 wherein said electrically conducting member on the cap includes a radially projecting lug capable of engaging into an opening in said second contact member.

5. An assembly according to claim 3 wherein the edges of the cap are rounded to facilitate the movement of the cap past the ribs during the transverse movement.

6. An assembly according to claim 3 wherein the edges of the cap are bevelled to facilitate the movement of the cap past the ribs during the transverse movement.

7. A cartridge fuse carrier assembly comprising: a housing; connection terminals for connecting the assembly into an electrical circuit; a recess in the housing for receiving a cartridge fuse; a first contact member in the recess and having an electrical connection with a first terminal; an insulating cap for closing the recess to secure the cartridge fuse therein; a second contact member in the housing and having an electrical connection with the second terminal; an electrically conducting member carried by the cap for co-operating with a first end member of the cartridge fuse, to provide an electrical connection between the first end member of the cartridge fuse and the second contact member; and engagement means on the cap co-operable with the housing for securing the cap at the opening of the recess, by displacement of the cap carrying the cartridge fuse in the axial direction of the recess whereby a second end member of the fuse is brought into abutment against said first contact member, and then displacement of the cap in a second rectilinear direction transverse with respect to the axial direction of the recess to bring the engagement means into the cap-securing position, an internal surface of the recess which in the cap-secured position lies adjacent a surface of the cap providing at least one rib, and said adjacent surface of the cap providing at least one groove capable of receiving the rib in the cap-secured position, whereby when the cap is inserted axially into the recess the rib and the groove are displaced relative to each other transversely of the axial direction of the recess by a distance at least substantially equal to the extent of said second rectilinear movement of the cap, the rib and the groove engaging each other with a snap action at least towards the end of said second rectilinear movement.

8. An assembly according to claim 7 wherein there are two said ribs on oppositely directed internal surfaces of the recess, and two said co-operating grooves on oppositely directed external surfaces of the cap, the rib and groove of each said co-operating pair being displaced relative to each other as aforesaid.

* * * * *

UNITED STATES PATENT AND TRADEMARK OFFICE

CERTIFICATE OF CORRECTION

PATENT NO. : 4,032,878

DATED : June 28, 1977

INVENTOR(S) : Pierluigi Ranzanigo

It is certified that error appears in the above-identified patent and that said Letters Patent are hereby corrected as shown below:

[73] The name of the Assignee should read

-- Bassani Ticino S.p.A. --

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*